United States Patent [19]

Lee

[11] Patent Number: 5,016,405

[45] Date of Patent: May 21, 1991

[54] MODULAR WORKSTATIONS

[75] Inventor: Michael E. Lee, Wolverton, Minn.

[73] Assignee: Rosemount Office Systems, Inc., Lakeville, Minn.

[21] Appl. No.: 582,988

[22] Filed: Sep. 14, 1990

Related U.S. Application Data

[63] Continuation of Ser. No. 339,963, Apr. 18, 1989, abandoned, which is a continuation of Ser. No. 164,574, Mar. 7, 1988, abandoned.

[51] Int. Cl.[5] ..... A47B 5/00

[52] U.S. Cl. ..... 52/36; 52/239; 108/60; 108/64; D6/421; D6/423

[58] Field of Search ..... 52/36, 238.1, 239; 160/135; 108/60, 64, 66, 90; D6/421, 423

[56] References Cited

U.S. PATENT DOCUMENTS

| | | | |
|---|---|---|---|
| D. 218,176 | 7/1970 | Marais | D6/421 |
| 2,961,280 | 11/1960 | Jentzen . | |
| 3,117,533 | 1/1964 | Martland . | |
| 3,181,920 | 5/1965 | Burr . | |
| 3,418,765 | 12/1968 | Propst et al. . | |
| 3,688,419 | 9/1972 | Woolman . | |
| 3,698,104 | 10/1972 | Sutton | 108/60 |
| 3,778,911 | 12/1973 | Woolman . | |
| 3,869,992 | 3/1975 | Kramer | 108/60 |
| 3,931,771 | 1/1976 | Kramer | 108/60 |
| 4,224,769 | 9/1980 | Ball et al. . | |
| 4,314,700 | 2/1982 | Dylag . | |
| 4,625,633 | 12/1986 | Martin . | |
| 4,761,921 | 8/1988 | Nelson | 52/239 |

OTHER PUBLICATIONS

Architectural Record; Feb. 1941, p. 49.

*Primary Examiner*—Michael Safavi
*Attorney, Agent, or Firm*—Kinney & Lange

[57] ABSTRACT

A workstation module has a plurality of work surface areas that are joined together around a central axis or core and the primary work surface area has five generally straight peripheral edges arranged to join at least one additional work surface and with one edge positioned for linking to another module. The edges of the primary work surface are arranged so the modules can be linked with other modules without trapping the workers.

10 Claims, 5 Drawing Sheets

MODULAR WORKSTATIONS

This is a continuation of application Ser. No. 07/339,963 filed on Apr. 18, 1989, abandoned as of the date of this application, which in turn was a continuation of application Ser. No. 07/164,574, filed Mar. 7, 1988, now abandoned.

BACKGROUND OF THE INVENTION

1. Field of the Invention

The present invention relates to workstation clusters or pods that can be easily linked together using minimum floor space while not severely restricting functional worker movement, and also permitting handicapped access.

2. Description of the Prior Art

The concept of having a central core that is used for forming a pod or cluster of workstations is shown in U.S. Pat. No. 4,625,633, and also the concept of using spaced pods has been advanced by Center Core, Inc., as exemplified by products sold by that company under the trademarks PENTAPOD and FOUR PLUS ONE, workstation areas. However, the cluster or pods that are formed tend to restrict the actual space in which a worker can operate, and can confine the workers. The arrangement also tends to provide unusable work surface area, particularly in the primary work zone.

Many patents have been advanced for various workstations, for classroom and office. For example, U.S. Pat. Nos. 3,688,419 and 3,778,911 both issued to Meyer and Woolman, show seating arrangements for six persons with the persons being divided into pairs or sets of two, and with no dividers between adjacent people. This is for paired learning arrangements in schools, but does not utilized isolation dividers between the pairs of persons, nor does it divide up the primary work surface counter.

U.S. Pat. No. 3,418,765 shows a coordinated system for activity isolation, but does not have efficiently arranged pods that can easily be clustered or linked together to minimize wasted space and provide adequate work area for workers. Other patents which show the state-of-the-art include the following:

| U.S. Pat. No. | Inventor(s) | Issue Date |
|---|---|---|
| 2,961,280 | Jentzen | November 22, 1960 |
| 3,117,533 | Martland | January 14, 1964 |
| 3,181,920 | Burr | May 4, 1965 |
| 4,224,769 | Ball et al. | September 30, 1980 |
| 4,314,700 | Dylag | February 9, 1982 |

SUMMARY OF THE INVENTION

The present invention relates to an office workstation system made up of a plurality of clusters or pods of individual workstations that can be linked together easily without substantially constricting the seating areas of the workers, and which efficiently utilize the primary work surface of each of the workstations.

DETAILED DESCRIPTION OF THE PREFERRED EMBODIMENTS

Figure 1:
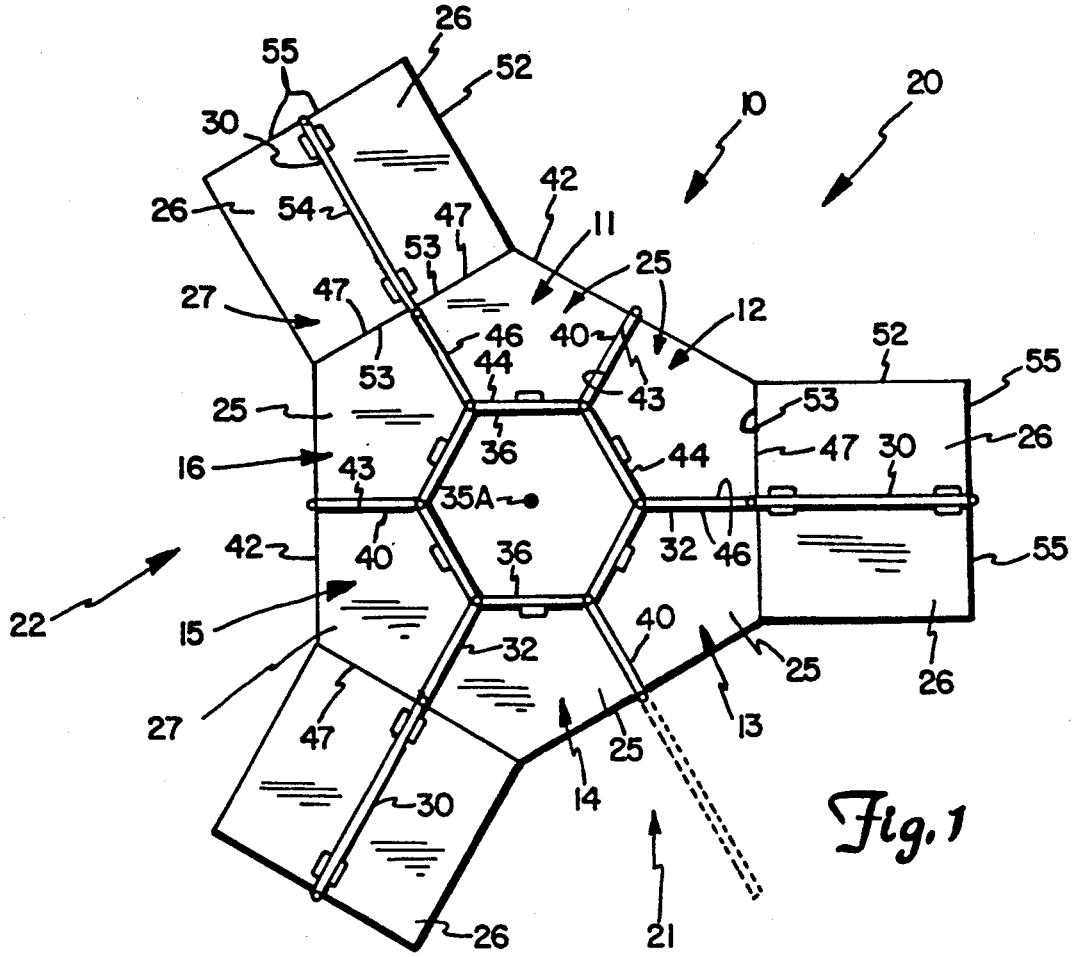
FIG. 1 is a top plan view of a workstation cluster or pod made according to the present invention utilizing six workstations.

Referring to FIG. 1, a workstation cluster or pod of the present invention indicated generally at 10, as shown, includes first, second, third, fourth, fifth, and sixth workstations shown at 11, 12, 13, 14, 15 and 16 when going in clockwise direction in FIG. 1. Each of the workstations 11–16 is designed to use modular panel systems and is for accomodating one worker. The cluster or pod is arranged, as shown with three pairs of workstations and no floor divider between the adjacent pairs. In other words, as shown, two workers will occupy essentially the same floor space area for pairs of workstations indicated generally at 20, 21, and 22, for three pairs of workers.

Optionally there can be a wall panel between the workstation in each pair, and a work surface panel as well.

Figure 5:
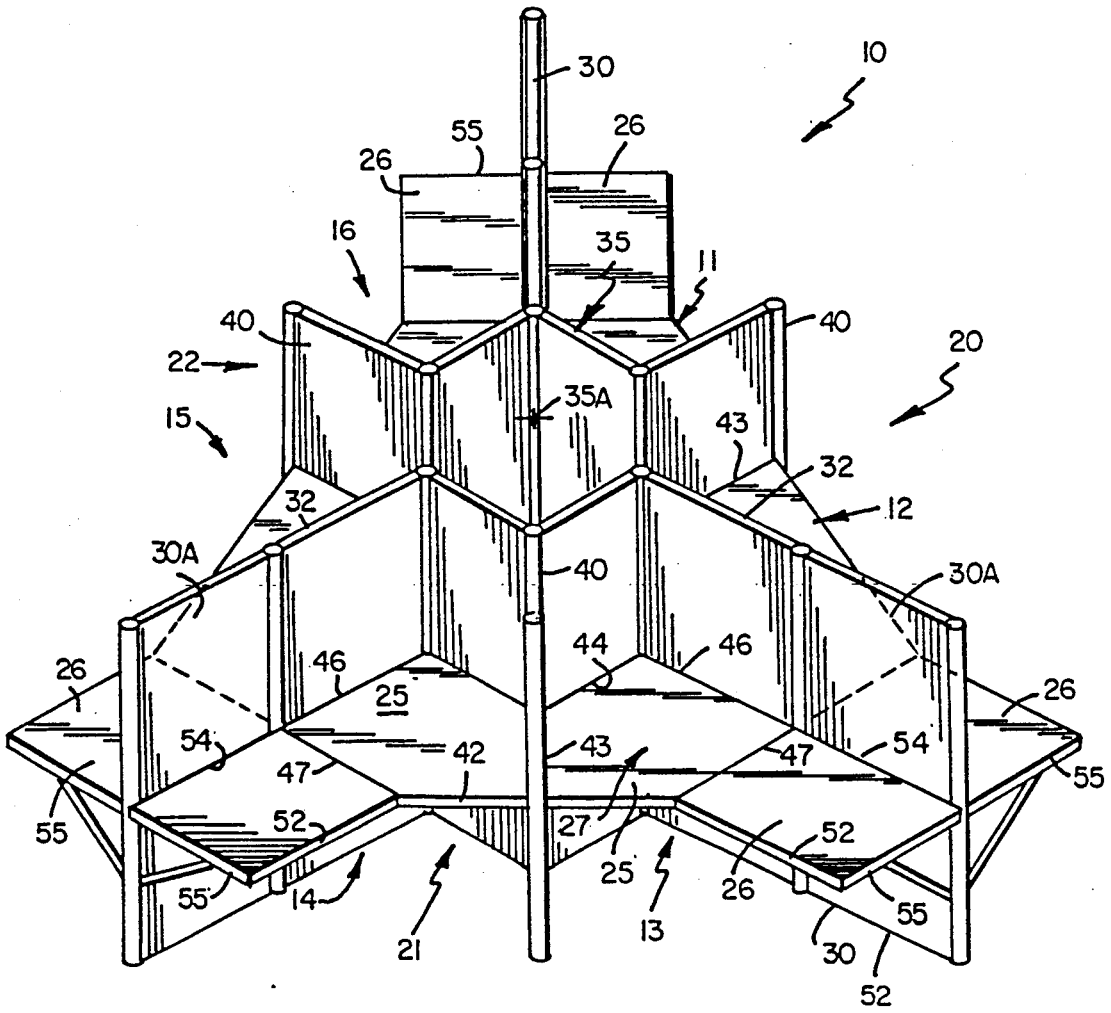
FIG. 5 is a perspective view showing a cluster or pod arranged as in FIG. 1.

The workstations 11–16 each include a primary work surface panel 25, and in this form of the invention, an auxiliary work surface panel 26 that mates with the work surface panel 25 to form a single workstation work surface 27 (see FIG. 5 as well). The workstation work surface 27 is supported on upright divider wall panels 30 that extend along the auxiliary work surface panel 26 and which extend upwardly to form dividers in a manner common for interior wall partitions. The panel part 30A (FIG. 5), which is above the work surface panel 26, provides a divider from an adjacent work surface panel.

The primary work surface panel 25 (FIG. 1) is supported on an upright divider wall panel 32 along one edge, again between the adjacent pairs of workstations. The work surface panel 25 defines a surface that has one edge facing toward and defining an open central core indicated generally at 35, which is also shown in FIG. 1, and this central core 35 is made up of a number of vertical partition height (which height can vary) wall panels indicated generally at 36, each of which extends along an edge of the primary work surface panel 25 of one of the workstations.

In each of the workstations the primary work surface is made up of five edged primary work surface panels 25. A first edge indicated at 42 is the edge that faces the worker. When as is normal, no auxiliary work surface panels are used, or where the work surface panel 25 for each of the workstations is continuous along the main divider 30 between pairs of workers, as shown in the modified form of FIG. 6, the edge 42 would extend outwardly in direction along divider panel 30 beyond that shown in FIG. 1. Edge 42, as can be seen, is not perpendicular to the radial line from the central axis 35A of the core 35 which bisects the edge 42, or stated another way edge 42 is not parallel to the divider panel 36 that divides that primary work surface from the interior of the center core. A second edge 43 of the work surface panel 25 joins the first edge 42 and extends radially in toward the central axis 35A of the core 35. This edge 43 is the edge that abuts the primary work surface panel of the workstation associated as a pair, for example the edge 43 of panel 25 of workstation 11 abuts the edge 43 of panel 25 of the workstation 12. The primary work surface panel 25 for station 12 is a mirror image of panel 25 for its paired workstation 11. The edge 43 of the primary work surface panel 25 of each workstation that is adjacent the edge 43 of the primary work surface panel 25 of the workstation in its associated pair. For example, the panels 25 for stations 11 and 12 (pair 20); 13 and 14 (pair 21) and 15 and 16 (pair 22) are separated from the other work surface in its pair by a modular divider wall panel 40 that divides only the adjacent work surface areas, but does not extend radially from the center beyond the edges 42 of the work surface panels. Divider panel 40 does divide the floor area between the work surface in each of the pairs of workstations. This can be seen in FIGS. 1 and 5, where the panel 40 is illustrated.

A third edge of each primary work surface panel 25 is shown at 44, and edge 44 mates with, and abuts against the wall panel 36 which defines part of the central core 35. A fourth edge 46 of each work surface panel extends radially from the central axis 35A of core 35, and forms a dividing edge between the adjacent pairs of workstations and workers along which the wall panel 32 extends.

Fourth edge 46, in the form shown in FIG. 1, terminates along a fifth edge 47 that extends back to join the first edge 42, and defines the end of and thus encloses the work surface. Edge 47 is perpendicular to edge 46.

It can be seen that when the worker faces the edge 42 of the primary work surface panel 25, the worker does not face directly into the central axis 35A of the central core. The line normal to the edge 42 and bisecting the edge is not a radial line from the central core axis 35A. The pairs of workers in the floor area for the pairs of workstations 20, 21, and 22 utilize adjacent and overlapping floor space so that there is freedom of movement and less confinement. The wall panel 40, dividing the primary work surfaces between the workers in each associated pair of workstations adequately separates out the primary work surface areas.

In the form shown in FIG. 1, each of the work surfaces or panel assemblies 27 includes a primary work surface panel 25 and an auxiliary work surface panel 26. Panel 26 mates with the edge 47 of panel 25 and has a first edge 52 that faces the worker, and forms a continuation of the edge 42. As shown, there is an included angle of less than 180° between edges 42 and 52, but these edges could be on a coinciding line. Additionally, there is an auxiliary work surface panel edge 53 that abuts against the fifth edge 47 of the primary work surface panel 25, and an edge 54 which forms a continuation of (is on a straight line extension of) the edge 46. Edge 54 extends radially from the central axis 35A of the central core 35. The divider wall panels 30 support the auxiliary work surface panels 26 in a conventional manner, and suitable supports can engage the floor at the outer end of the auxiliary work surface panel 26 if desired. The auxiliary work surface panel has an outer edge 55 that is parallel to the fifth edge 47 of the primary work surface area panel 25, and forms an edge for linking to additional workstation clusters or pods.

Each of the workstations 11–16 has the same primary work surface panel 25 as shown, but the panels 25 for the workstations in each pair are mirror images of each other. Each panel 25 has five edges that provide the ability to have the extension or auxiliary work surface panels 26 and which make it easy to link adjacent clusters, because of the extensions of these panels. There are no work surfaces between the individual workers of each pair, for less confinement.

The divider wall panels 32, 36, and 40 can be the desired height and of widths selected for modular construction, for example a two-foot width. The divider wall panel 30 can be a four-foot width.

Divider wall panels may be used between workers of each pair of workstations as shown in dotted lines between workstations 13 and 14 in FIG. 1, but are only a narrow divider wall, without work surfaces on opposite sides is used to insure that each of the workers has adequate floor space. The layout of the work surface area in the present five-sided arrangement makes the useable work surface substantially equal to that of prior devices that had long radial dividers and workstations on each side of each worker. The work surface panels 25 do not have a radial depth that makes a substantial portion unuseable. The depth of the primary work surface area is in the range of a maximum of slightly over two feet. The divider panels 36 and 40 comprise standard two-foot panels in the form shown, so that the central core as shown in FIG. 1 is made up of standard width (modular) panels that define the core periphery in hexagon shape, and provide workstations for six workers.

Figure 2:
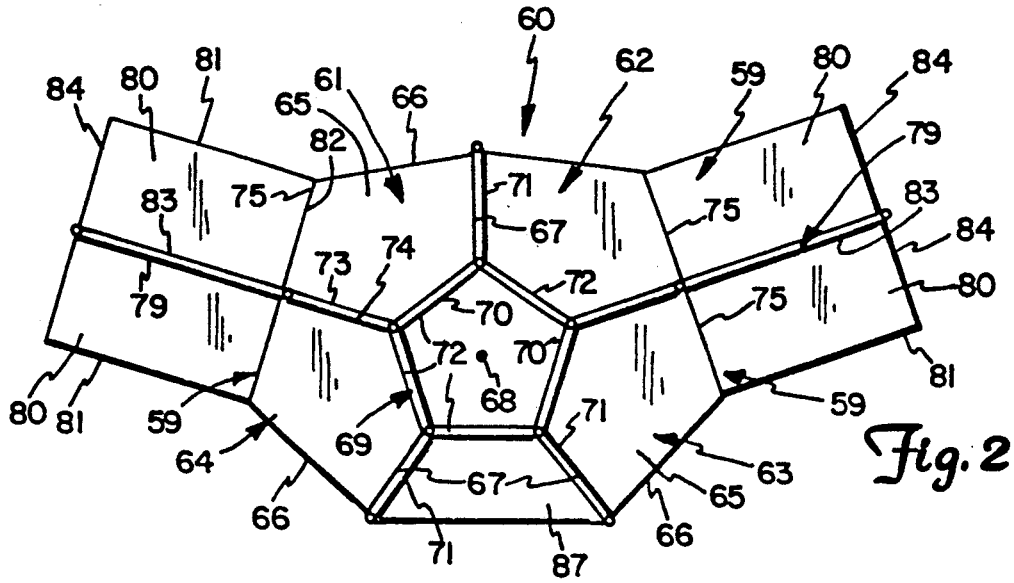
FIG. 2 is a top plan view of a further modified form of the present invention utilizing four workstations arranged around a central core.

FIG. 2 shows a workstation cluster for four workers, and in this instance the workstation cluster or pod indicated generally at 60 includes a first workstation 61, a second workstation 62, a third workstation 63, and a fourth workstation 64. These workstations as illustrated in FIG. 2 are arranged around a five-sided central core 69 again made up of standard wall divider panels, and each workstation includes a work surface 59 having a primary work surface panel 65, that has a first edge 66 that faces a user, a second edge 67 that extends radially from a central axis 68 of central core 69, which in this form of the invention forms a pentagon.

A divider wall and support panel 71 is positioned along edge 67 of each work surface panel in adjacent pairs of workstations. Divider panel 71 corresponds to divider panel 40. The primary work surface panel 65 also has a third edge 70 which is abutted on a divider wall panel 72. The divider wall panels 72 are used to define the central core 69 and correspond to panels 36 in the first form of the invention.

The primary work surface panel 65 has a fourth edge 73 that extends radially from axis 68 along a divider wall panel 74, which also is radially extending from the central axis 68 of the central core 69. Work surface panel 65 has a fifth closing edge 75 which extends from edge 73 to join edge 66, and is generally perpendicular to the edge 73.

An auxiliary work surface panel 80 is provided for forming each work surface 59 in the same manner as the auxiliary work surface panel 26. Auxiliary panel 80 is supported on suitable vertical divider panels that extend to the floor and are indicated at 79 in FIG. 2. The auxiliary work surface panel 80 has a first edge 81 which faces the worker using the workstation and which joins edge 66 of its respective primary work surface panel 65. The edges 66 and 81 form an included angle of less than 180°. The auxiliary work surface panel 80 has a second edge 82 that mates with the edge 75 of panel 65, and has a third edge 83 that is aligned with and forms an extension of the edge 73, which is radially extending from the central axis 68 of the central core 69. The panel 80 has a fourth outer end edge 84, which is perpendicular to edge 83 and joins first edge 81.

In this form of the invention, a horizontal filler panel 87 is provided between two upright divider wall panels 71 that are at the respective side edges 67 of the workstations 63 and 64. The filler panel 87 fulfills a function by providing a finished appearance to the cluster or pod and can be used as a table or storage surface. The workstations 61 and 62 form one pair of workstations and workstations 63 and 64 form a second pair, even with filler panel 87 in place, because there are no radially extending work surfaces between workstations 63 and 64.

The outer edges 84 of the auxiliary work surface panels 80 form edges for linking the cluster with additional workstation clusters, for making maximum efficient use of the floor space available.

The workstation clusters just described in FIGS. 1 and 2 provide for easy linking of the clusters or pods into an efficient overall office configuration, with a saving of floor space but yet providing adequate space for the workers. For example, in FIG. 3, an office layout utilizing the workstation clusters or pods 10 is illustrated. For example, a cluster or pod 10A made according to the showing in FIG. 1, has its edges 55 at the outer ends of two adjacent workstations on opposite sides of a divider 30 (which divides one pair of stations from the other) abutting against the edges 55 of two work surfaces of an identical workstation cluster 10B. Each of the clusters 10A and 10B are made up of three pairs of workstations, and it can be seen that the addition of lateral work surface panels or secretarial returns such as those shown at 100, does not affect substantially the ability of the workers seated in chairs illustrated generally at 101, to move about in the respective workstation areas. The linking of the pods or clusters 10 provides for open space for the workers. The cluster or pod 10B has an additional cluster 10C which is linked to two of the outer work surface edges 55, and an additional cluster 10D linked at the outer edges 55 of two different workstations of the pod or cluster 10B. A pod or cluster 10E is linked to outer edges 55 of two work surfaces of workstations of the pod or cluster 10D. Upright divider panels can be placed between the edges 55 of adjacent linking clusters, if desired. The center core of pod 10C surrounds a building pillar, as shown.

Even with the additions of the auxiliary work surface panels or secretarial returns 100 on the pods or clusters, adequate room exists for the workers that are seated in the chairs 101. Note that where the clusters are linked, the secretarial returns are positioned to be abutting of adjacent workstations.

Figure 3:
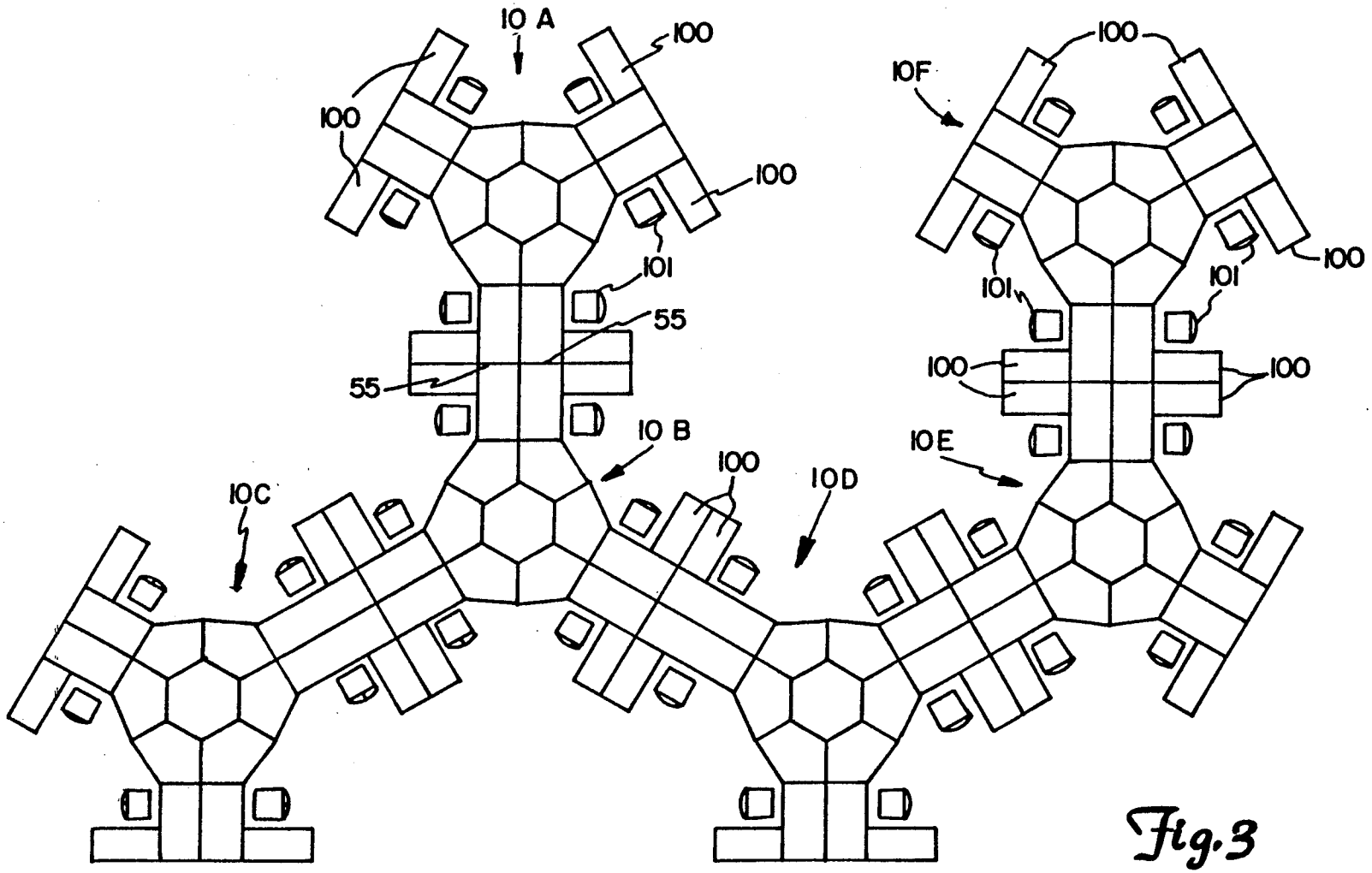
FIG. 3 is a top plan view of a typical linked set of clusters of workstations such as those made according to showing in FIG. 1.

To link workstation clusters or pods into a work enclosure, a workstation cluster or pod 10F can be linked to the edges 55 of two workstations of the cluster 10E. The pods or clusters 10A, 10B, 10D, 10E and 10F substantially surround a common central area. The layout shown in FIG. 3 is thus illustrative of a typical arrangement utilizing workstation clusters or pods made according to the present invention that have six individual workstations arranged in three sets of pairs as described in connection with FIG. 1.

Figure 4:
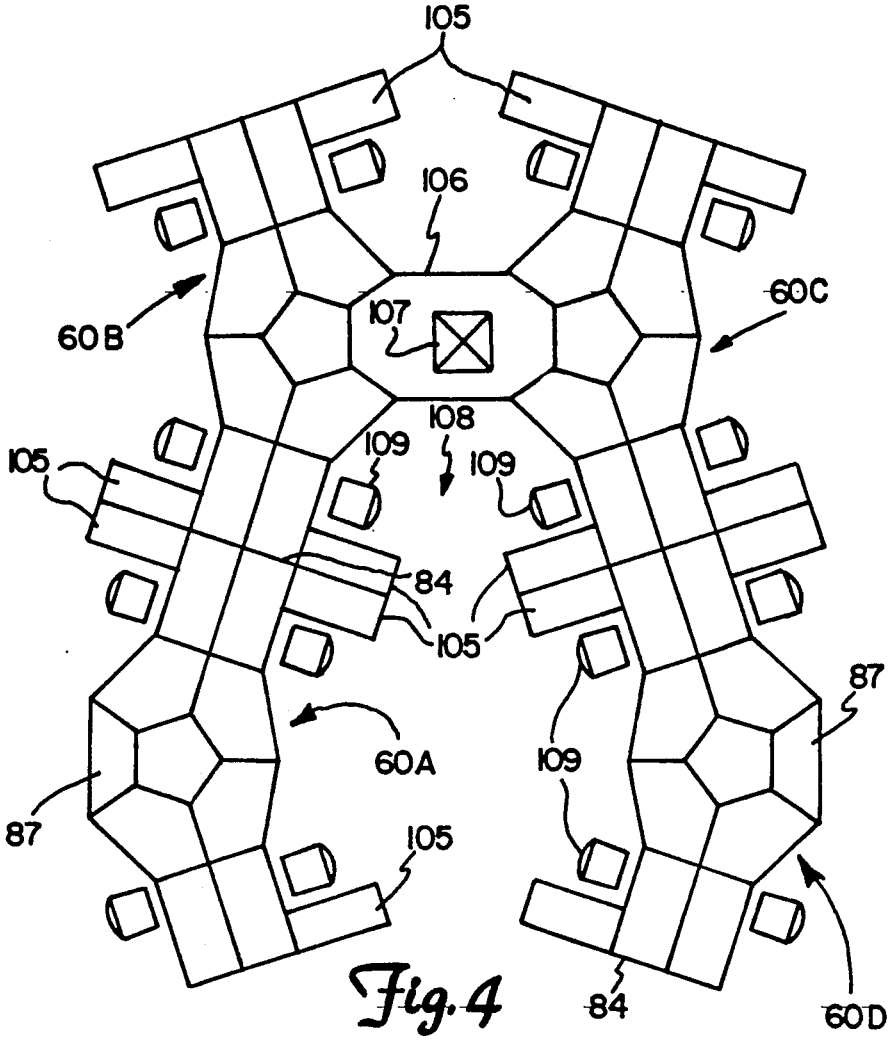
FIG. 4 is a top plan view of a typical arrangement of clusters or workstations linked together, wherein the workstations are formed substantially as shown in FIG. 2.

In FIG. 4, a work room environment utilizing the workstation clusters or pods such as those shown at 60 in FIG. 2 is shown in plain view. A pod 60A is made identically to that shown in FIG. 2, except that there are lateral wing auxiliary work surface panels 105 connected to the outer ends of extending work surface portions, and extending at right angles thereto. The pod 60A has outer end edges 84 of two of its workstations linked to corresponding edges of an identical pod 60B. A series of upright divider wall panels indicated generally at 106 can be used for linking around or surrounding a pillar 107 of the building. The panels 106 are similar to panels 79 and visually link the workstation cluster or pod 60B with a workstation cluster or pod 60C, which has the same workstation arrangement as shown in FIG. 2. The pod 60C can be linked with end edges 84 of work surfaces abutting on the end edges 84 of a further pod 60D to show additional variations in layout. Of course, the pods 60 such as that shown in FIG. 2 can be linked in a long series or chain, with slight snaking back and forth for visual effects, such as that would be shown if additional pods were added onto the outer end edges 84 of the pod 60D.

In this layout of the workstation cluster or pod of the present invention, the individual workers are not trapped and there is adequate space for movement even where the laterally extending work surface areas 105 are the closest, such as that shown in the general region 108, where the pods 60B and 60C are spaced apart by the panels 106. Workers in chairs 109 have adequate room for movement.

Figure 6:
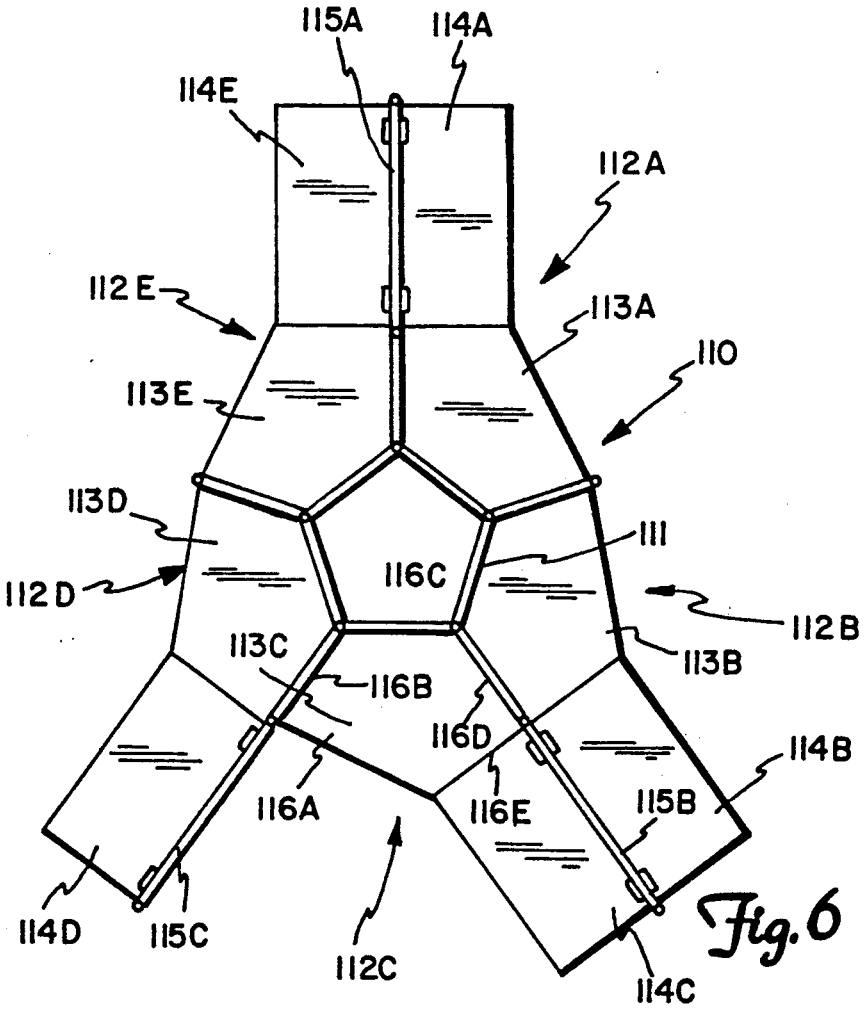
FIG. 6 is a top plan view of a workstation cluster or pod utilizing five workstations.

FIG. 6 shows a modified form of a workstation cluster showing five workstations arranged around a central core. This workstation cluster 110 comprises a five sided (pentagon) central core member 111 for making five individual workstations 112A–112E. In this form of the invention, workstation primary work surface panels 113A–113E are arranged around the central core 111, and dividers between the individual panels are used, as illustrated in the previous forms of the invention. Each of the workstation primary work surface panels 113A–113B has an edge against which an auxiliary work surface panel 114A–114E, respectively, is mounted. There are divider walls 115A and 115B between the auxiliary worksurface panels 114A and 114E and between the auxiliary worksurface panels 114A and 114C.

In this form of the invention, the workstation 112C is differently shaped from the others, in that it is not paired with or open to provide a common floor area with another station. A divider wall panel 115C is provided along the one side of the auxiliary work surface panel 114D to separate the workstation 112C from the workstation 112D.

The five sided primary work surface panels 113 are provided to give an adequate size work area, and the linking of clusters can be done by abutting the clusters at the ends of the auxiliary work surface panels 114A, 114E and 114B, 114C. Modular vertical divider wall panels again can be used for the core and divider wall panels 115A–115C. The five edges of the primary work surface panels are as shown in the drawings in FIG. 6 and arranged in a similar manner to that shown in FIGS. 1 and 2. Slightly different overall shapes of the workstation 112C, however is required.

In the workstation 112C (and for each other workstation), the primary work surface panel 113C has a first edge 116A that faces the worker, a second edge 116B which forms a dividing line between the adjacent primary work surface panel 113D, a third edge 116C which faces the open central core, a fourth edge 116D which extends radially away from the open central core and defines a divider between the primary work surface panel 113C and the primary work surface panel 113B, and an edge 116E which comprises the fifth edge of the primary work surface panel that joins the edge 116A and the edge 116D.

The workstation cluster 110 therefore defines a easily adapted cluster for linking with other clusters, on at least two protruding ends thereof.

The panels that divide the individual workstations can be desired heights as previously explained and as shown in FIG. 5. The cluster arrangement permits substantial freedom of movement and adequate space for workers even for workstation 112C.

Figure 7:
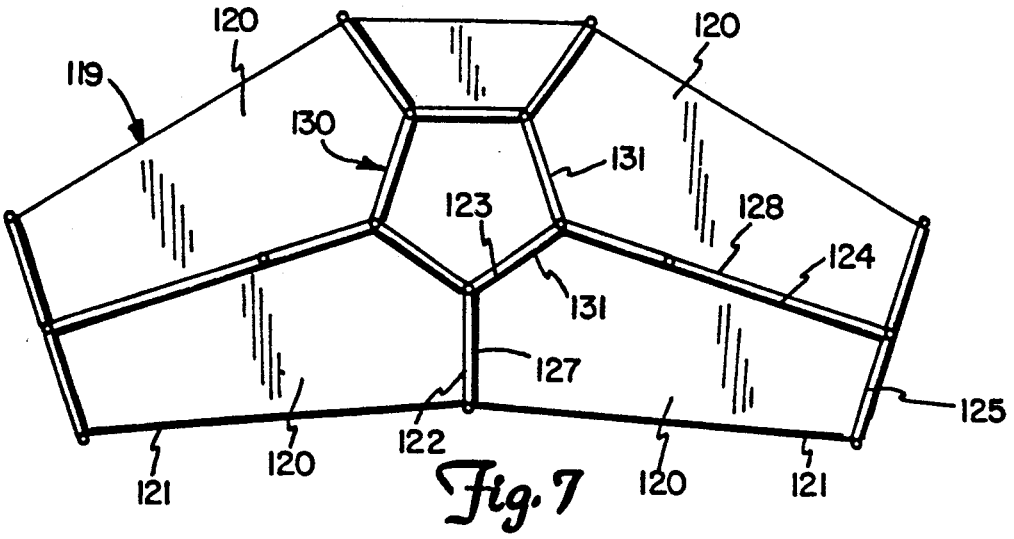
FIG. 7 is a modified form of a workstation cluster made according to the present invention.

FIG. 7 shows a typical workstation cluster 119, similar to that shown in FIG. 2, which has work surface panels 120 for the workers that are not divided into primary and auxiliary panels such as that shown at 65 and 80 in FIG. 2. In other words, the work surface panels 120 are the same five-sided shape, except that the edges 121 of the work surface area facing the workers are continuous. The work surface panels 120 have five edges 121, 122, 123, 124, and 125. The end edges 125 are the linking edges at an outer end of the work surface, and correspond to the edges 84.

The work surface panels 121 are divided from adjacent work surface panels by vertical upright divider wall panels indicated at 128. A central core 130 is defined by upright wall panels 131 that are positioned along edges 123 and which extend vertically to the desired height. The panels 131 are supported on the floor. The work surface panels are divided from the abutting panel (not for the same pair of workers) by divider panels 127 which are shown.

This construction of the module is substantially identical to that shown in FIG. 2 except for the edges 121 and the fact that the work surfaces are in one piece. The same advantages of linking can be obtained with this configuration.

Although the present invention has been described with reference to preferred embodiments, workers skilled in the art will recognize that changes may be made in form and detail without departing from the spirit and scope of the invention.

What is claimed is:

1. A linkable cluster workstation arrangement comprising a first cluster of workstations supported on a floor surface having:

at least first, second third and fourth workstations arranged around a central open core, the core has upright partition walls joined at upright edges and forming a perimeter of a regular equal sided polygon of at least five and no more than six sides, the core having a central axis with the corners of the polygon on radial lines from the central axis, each workstation comprising a first work surface panel having a generally horizontal work surface bounded by five outer peripheral edges defining the shape of an irregular pentagon, the work surface panel, comprising a first straight line edge facing toward a space for a person working at the work surface panel, a second edge joining the first edge and extending inwardly toward the open core at an angle less than 180° relative to the first edge, the second edge lying substantially on a radial line from the central axis and defining a dividing line between the first work surface panel for a first workstation and the first work surface panel for a second workstation;

each work surface panel having a third straight line edge joining the second edge at a corner of the polygon core and arranged at an angle less than 180° to the second edge, said third edge abutting on one upright partition wall forming the perimeter of open core, a fourth edge joining the third edge at a corner of the respective upright partition wall abutted by the third edge, the fourth edge extending away from the open core a desired amount substantially along a radial line from the central axis and defining a divider line between the first work surface panel for the first workstation and the first work surface panel for a third workstation, and a fifth straight line edge of the work surface panel joining the first edge and the fourth edge thereof, said polygon central core being bounded by the third edges of at least the four work surface panels and the corners between the third edges and the respective second and fourth edges of each work surface panel defining the corners of such polygon core; and the fifth edges of adjacent work surface panels aligning to form a straight line, the fifth edges facing outwardly from the central axis and being unobstructed to receive further work surface panels abutted thereagainst to extend outwardly from the first mentioned work surface panels of the first cluster.

2. The cluster of workstations of claim 1 and vertical divider wall means for the workstations, the fourth edge of at least two sets of adjacent workstations being separated by the vertical divider wall means, said vertical divider wall means extending upwardly above the first work surface to form a partition between said adjacent workstations.

3. The cluster of workstations of claim 1 wherein there are six workstations in the cluster, and the central core defined thereby is enclosed as a hexagon.

4. The cluster of workstations as specified in claim 3 wherein the six workstations have work surface panels arranged to form three pairs of work surface panels arranged symmetrically around a central axis of the core, and a separate vertical divider panel between the radially extending fourth edge of the work surface panels that extend substantially from a supporting surface for the clusters to a distance above the work surface areas to provide a divider between pairs of workstations, only, whereby an area of space for seating at the pairs of workstations is available to be shared by persons at the respective workstations of the pair.

5. A workstation cluster supported on a support surface comprising:

at least six workstations arranged around a central open core having a central axis and a hexagon perimeter, the six workstations being arranged in three pairs of workstations, each pair comprising a first and a second workstation adjacent to each other, each workstation comprising a panel supported at a work surface height above the support surface and having five edges defining an outer periphery formed as an irregular sided pentagon panel which defines a first work surface area for each workstation, the irregular pentagon panel comprising a first edge facing toward a space for a person working at the work surface area and supported on the support surface, a second edge joining the first edge at a corner junction and extending inwardly toward the axis of the open core at an included angle of less than 180° to the first edge and forming a separate dividing line between the irregular pentagon panel having the first work surface area for a first workstation of each pair of workstations and the irregular pentagon panel having the first work surface area for a second workstation of the same pair of workstations, the dividing line being generally along a radial line from the central axis;

and the irregular pentagon panel further being defined by a third edge joining the second edge and arranged at an included angle of less than 180° with the second edge, said third edge defining one portion of the hexagon perimeter of the central open core;

the irregular pentagon panel further being defined by a fourth edge joining the third edge and extending away from the central open core along a substantially radial line from the central axis a desired amount and defining a divider line between the irregular pentagon panel having first work surface area for the first workstation of one pair of workstations and the irregular pentagon panel having the first work surface area for a workstation of a different pair of workstations, the second and fourth edges forming an included angle of substantially 60°; and a fifth edge joining the first edge and the fourth edge to enclose the periphery of the irregular pentagon panel and the first work surface area thereof, each pair of workstations having vertical divider walls extending outwardly between the fourth edges of each irregular pentagon panel to separate each pair of workstations from the next adjacent workstations, and the first and second edges of the irregular pentagon panels of the first and second workstations being adjacent each other and the first edges of the irregular pentagon panels of the first and second workstations of each pair of workstations extending in opposite directions from the corner junctions defined by the respective first and second edges, there being no obstructions between the first and second workstations forming each pair of workstations extending from the central core farther than the corner junctions defined by the respective first and second edges.

6. The cluster of workstations of claim 5 and vertical wall panel means along the third edges of the workstations to define the central core.

7. The cluster of workstations of claim 5 wherein there is a divider wall extending from a support surface to a location above the irregular pentagon panels between the second edges of the two irregular pentagon panels of adjacent first and second workstations forming each pair of workstations.

8. The cluster of workstations of claim 5 wherein the fifth edges of the first work surface areas of first and third workstations having coextensive fourth edges are substantially perpendicular to the fourth edges and are aligned to form a fifth edge set, whereby a similar set of fifth edges of a second cluster of workstations having workstations arranged as in the first cluster can be linked to the first cluster by abutting the fifth edges of the first and third workstations of the first and second clusters.

9. A workstation assembly comprising a plurality of upright, partition height wall panels each having a lateral width and formed into an equal sided hexagon shape around a central upright axis;

a plurality of workstations arranged to the exterior of said upright wall panels including separate work surface panels for each of said workstations, and each of said work surface panels having first, second, third, fourth and fifth edges arranged in the shape of an irregular pentagon, the third edges of each of the work surface panels extending along and corresponding in length to the lateral width of a corresponding one of the upright wall panels;

the second and fourth edges of each of said work surface panels joining ends of the respective third edge and extending along radial lines from the upright central axis outwardly from edges of the respective upright wall panels, the second and fourth edges terminating outwardly from the respective wall panels, the first edge joining an outer end of said second edge and extending in the same direction but diverging from the third edge of the respective panel, and a fifth edge joining an outer end of the respective fourth edge, and intersecting and joining the respective first edge;

separate work surface panels being arranged to form workstation pairs of work surface panels, with the first edges of the work surface panels of each pair substantially lying along a single straight line, and with the fifth edge of each panel in a pair aligning on a straight line with the fifth edge of a panel of an adjacent pair of work surface panels, said fifth edges being substantially perpendicular to the respective fourth edges which they join;

substantially rectangular auxiliary work surface panels, each having one edge of substantially the same length as and abutting against the fifth edge of a separate work surface panel, and the auxiliary work surface panels having another edge at substantially right angles to the one edge lying along a line which is an extension of the fourth edge of the respective work surface panel, said auxiliary work surface panels each forming an auxiliary work surface area that extends outwardly from the central axis a greater distance than the fifth edges of the first mentioned works surface panels; and vertical radial divider walls between adjacent pairs of the first mentioned work surface panels, said vertical divider walls extending along and between the fourth edges of adjacent first mentioned work surface panels of different pairs and being positioned to extend outwardly between the auxiliary work surface panels abutted to the respective first mentioned work surface panels.

10. The assembly as specified in claim 9 and second upright divider walls extending between the second edges of the first mentioned work surface panels of each pair at a location above the respective first mentioned work surface panels only, the second upright divider walls extending radially outward from the central axis a distance not substantially greater than the distance of the junctions between the first and second edges of each of the respective first mentioned work surface panels to leave an area between the auxiliary work surface panels abutted to the fifth edges of the pairs of first mentioned work surface panels substantially unobstructed in the region outwardly from the first edges of the first mentioned work surface panels of each pair.

* * * * *

UNITED STATES PATENT AND TRADEMARK OFFICE

CERTIFICATE OF CORRECTION

PATENT NO. : 5,016,405

DATED : May 21, 1991

INVENTOR(S) : Michael E. Lee

It is certified that error appears in the above-identified patent and that said Letters Patent is hereby corrected as shown below:

Col. 7, line 55, after "second", insert a --,--

Col. 8, line 37, delete "edge", insert --edges--.

Col. 8, line 60, delete "at least".

Signed and Sealed this

Sixth Day of October, 1992

*Attest:*

*Attesting Officer*

DOUGLAS B. COMER

*Acting Commissioner of Patents and Trademarks*